US010514047B2

(12) United States Patent
Meneghel et al.

(10) Patent No.: US 10,514,047 B2
(45) Date of Patent: Dec. 24, 2019

(54) SUBMERSIBLE PUMP AND METHOD OF PUMPING FLUID

(71) Applicant: PUMPENG PTY LTD, Western Australia (AU)

(72) Inventors: Paul Meneghel, Western Australia (AU); Tony Murray, Western Australia (AU)

(73) Assignee: PUMPENG PTY LTD, Canning Vale, Western Australia (AU)

( * ) Notice: Subject to any disclaimer, the term of this patent is extended or adjusted under 35 U.S.C. 154(b) by 667 days.

(21) Appl. No.: 15/124,552

(22) PCT Filed: Mar. 11, 2015

(86) PCT No.: PCT/AU2015/000137
§ 371 (c)(1),
(2) Date: Sep. 8, 2016

(87) PCT Pub. No.: WO2015/135020
PCT Pub. Date: Sep. 17, 2015

(65) Prior Publication Data

US 2017/0097017 A1 Apr. 6, 2017

(30) Foreign Application Priority Data

Mar. 11, 2014 (AU) ..... 2014900824

(51) Int. Cl.
*F04D 27/00* (2006.01)
*F04D 29/70* (2006.01)
(Continued)

(52) U.S. Cl.
CPC ..... *F04D 29/708* (2013.01); *F04D 7/045* (2013.01); *F04D 13/08* (2013.01); *F04D 13/086* (2013.01); *F04D 27/009* (2013.01)

(58) Field of Classification Search
CPC ..... F04D 29/708; F04D 7/045; F04D 13/08; F04D 13/086; F04D 27/009; F04D 25/0686
See application file for complete search history.

(56) References Cited

U.S. PATENT DOCUMENTS 2,470,563 A * 5/1949 Jennings ..... F02M 37/103 417/423.3
4,747,757 A 5/1988 Haentjens
(Continued)

FOREIGN PATENT DOCUMENTS

EP 0440046 A1 8/1991
EP 0519176 A1 12/1992
(Continued)

OTHER PUBLICATIONS

International Search Report and Written Opinion for Application No. PCT/AU2015/000137 dated May 5, 2015 (11 pages).
(Continued)

*Primary Examiner* — Woody A Lee, Jr.
*Assistant Examiner* — Sabbir Hasan
(74) *Attorney, Agent, or Firm* — Michael Best & Friedrich LLP

(57) ABSTRACT

A pump (100) has an inlet (28), a first outlet (30) and a second outlet arrangement. The pump (100) is arranged so that when operated in a body of water (104), water from that body of water (104) is pumped thought the first outlet to a remote location. Additionally liquid is delivered to the second outlet system (102) which subsequently flows out from the second outlet system (102) back into the body of water (104) to create a flow of the liquid back into the body of water 104 and away from the pump (100). The liquid can be water from the body of water (104). In this instance a portion of the water at the first outlet can be diverted to the
(Continued)

second outlet arrangement. But alternately liquid can be sourced externally from the body of water (104).

10 Claims, 5 Drawing Sheets

(51) Int. Cl.
*F04D 7/04* (2006.01)
*F04D 13/08* (2006.01)

(56) References Cited

U.S. PATENT DOCUMENTS

| | | | | |
|---|---|---|---|---|
| 5,141,390 | A | 8/1992 | Haentjens | |
| 6,843,003 | B2 * | 1/2005 | Araoka | E02F 3/9212 37/317 |

FOREIGN PATENT DOCUMENTS

| | | | |
|---|---|---|---|
| EP | 1200738 | B1 | 5/2002 |
| EP | 1270826 | | 1/2003 |
| JP | S5575599 | | 6/1980 |
| JP | S5618095 | | 2/1981 |
| JP | S5618096 | | 2/1981 |
| JP | S5666485 | A | 6/1981 |
| JP | S56104192 | | 8/1981 |
| JP | 2002322995 | | 11/2002 |
| JP | 2005188490 | A | 7/2005 |
| JP | 2010038025 | A | 2/2010 |
| WO | 2008141381 | | 11/2008 |

OTHER PUBLICATIONS

International Preliminary Report on Patentability for Application No. PCT/AU2015/000137 dated Jul. 4, 2016 (23 pages).
European Patent Office Search Report for Application No. 15762033.7 dated Feb. 24, 2017, 8 pages.
Chilean Patent Office Examination Report for Application No. 8379767-3 dated Aug. 9, 2018, 13 pages.

* cited by examiner

SUBMERSIBLE PUMP AND METHOD OF PUMPING FLUID

TECHNICAL FIELD

A submersible pump and method of pumping fluid are disclosed.

BACKGROUND ART

Submersible pumps are used in many different application and industries. A submersible pump has an electric motor disposed within a liquid tight housing with a drive shaft of the motor extending from the housing. An impeller is connected to the shaft and disposed within a pump casing. The casing has an inlet through which fluid is drawn into the pump. When the submersible pump is submersed in or otherwise lowered into a body of fluid and operated, the fluid is drawn into the inlet and directed to an outlet via the action of the motor and impeller. A hose may be connected to the outlet of the pump to channel the fluid to a remote location or tank.

In the context of this specification including the Claims the term "submersible pump", is intended to include, but is not limited to, a semi-submersible pump or any pump which is required to be at least partially submersed in a liquid in order for a suction side of the pump to draw the liquid.

In some applications solid matter is contained in the fluid to be pumped. To reduce clogging and damage to the pump a strainer can be provided up stream of the inlet. The strainer acts to impede and indeed prevent the passage of the solid matter of a size larger than the "mesh size" of the strainer from entering the inlet. The strainer can form a peripheral wall of chamber at a bottom end of the pump within which the inlet is disposed. The bottom end may be open or covered by the strainer. In the event of an open bottom, the bottom of chamber can in use be substantially closed by resting the bottom of the chamber on a submerged surface.

To provide context in one example submersible pumps are sometimes used to dewater excavations during and following the application of shotcrete. It is known for shotcrete to include or incorporate metal reinforcing fibres or strands. During the dewatering process these fibres or strands normally do not cause any significant problems in relation to the operation of the pump. The reason for this is that the specific gravity of the fibres or strands is such that they tend to settle at the bottom and are not drawn in or picked up by the flow of water through the inlet or strainer when provided.

However, it is becoming more common to utilise, in shotcrete, reinforcing strands or fibres having a specific gravity less than that of water. For example fibre glass strands. These are entrained in and carried by the water being drawn in to the inlet by the impeller. The provision of a strainer as described above is intended to prevent this from occurring. But in practise the strainer becomes rapidly blocked. Further while these fibres are relatively long they are very narrow and therefore many pass through the strainer and the inlet into the pump casing. This causes substantial damage and ultimately, if not detected early, failure of the submersible pump.

The above discussion is not intended to limit the application of the submersible pump and method of pumping as disclosed herein.

SUMMARY OF THE DISCLOSURE

In broad terms the general idea of the disclosed submersible pump and pumping system is to create a flow of fluid to push floating material away from a fluid intake or inlet. This is sometimes referred to as a "divergent flow". In this way it is possible to reduce the likelihood or at least the rate of clogging of the inlet and damage and wear to the internal parts of the submersible pump such as an impeller. One way of doing this is to provide the submersible pump with a second outlet arrangement by which a fluid can be delivered into a body of fluid being pumped in a manner to flow away form the submersible pump.

The fluid delivered by the second fluid outlet arrangement can be sourced from the body of fluid being pumped by the submersible pump or from another source such as but not limited to mains water.

In the first aspect there is disclosed a submersible pump comprising:

- a fluid inlet, a first fluid outlet and a second fluid outlet arrangement, wherein at least the first fluid outlet is in fluid communication with the fluid inlet;
- the second fluid outlet arrangement being configured such when the submersible pump is in a body of fluid and operated to draw fluid from the body into the fluid inlet, a fluid can be delivered by the second outlet arrangement into the body of fluid in a manner to flow away from the submersible pump.

In one embodiment the second fluid outlet arrangement is configured to receive fluid from the body of water. In this embodiment the fluid delivered by the second outlet system is sourced from the body of fluid being pumped. This may be achieved in a number of different ways. For example:

(a) by configuring the submersible pump such that the second outlet arrangement is in fluid communication with fluid inlet;

(b) by plumbing the second outlet arrangement to a hose attached to the first fluid outlet;

(c) by attaching an auxiliary pump to a housing of the submersible pump for pumping fluid from the body of fluid to the second outlet arrangement.

However in an alternate embodiment the second outlet arrangement may be configured to receive fluid from an alternative fluid source, for example mains water. In that event the fluid delivered by the second outlet arrangement is different to the fluid in the body of fluid. One simple way of achieving this is to attach a spray manifold about a housing of the submersible pump and connect the manifold to a mains water supply.

In the second aspect there is disclosed a submersible pump comprising:

- a fluid inlet, a first fluid outlet and a second fluid outlet arrangement, the first fluid outlet and the second fluid outlet arrangement being in fluid communication with the fluid inlet;
- the fluid inlet, the first fluid outlet and the second fluid outlet arrangement being configured such that, when the submersible pump is in a body of fluid and operated to draw fluid from the body into the fluid inlet, a portion of the fluid being drawn into the inlet is returned to the body of the fluid through the second outlet arrangement.

In one embodiment the second outlet arrangement is configured to produce a flow of fluid into the body of fluid in at least two divergent directions relative to the submersible pump.

In one embodiment the second outlet arrangement is configured to return the portion of fluid to the body of fluid in a manner to create a flow of fluid in the body radiating away from a circumferential surface of the submersible pump.

As a result of the above features of the disclosed submersible pump, floating solid matter such as but not limited to strands or fibres in the body of fluid can be pushed away from the submersible pump and in particular the inlet.

In the third aspect there is disclosed a submersible pump comprising:

a fluid inlet;

a first fluid outlet in fluid communication with the fluid inlet wherein fluid entering the inlet is directed to the first fluid; and a second outlet arrangement arranged such that a portion of the fluid being directed to the first outlet is diverted to the second outlet arrangement.

In one embodiment the second outlet arrangement is configured to produce a flow of fluid into in at least two divergent directions away from the submersible pump.

In one embodiment the second outlet arrangement comprises a continuous opening formed about the submersible pump.

In an alternate embodiment the second outlet arrangement comprises a plurality of fluid discharge openings spaced about the submersible pump.

In one embodiment the plurality of fluid discharge openings comprise respective nozzles.

In a further alternate embodiment the second outlet arrangement comprises a plurality of slot like openings formed about the submersible pump.

In one embodiment the submersible pump comprises a fluid flow path upstream of the first outlet and arranged to channel the portion of the fluid to the second outlet arrangement prior to reaching the first outlet.

In one embodiment the submersible pump comprises a first housing in which is disposed a motor, and a second housing in which is disposed a pump case and an impeller, wherein the motor is arranged to impart torque to the impeller; and wherein the second outlet arrangement is formed as one or more openings disposed between the first and second housings.

In some of the above aspects the submersible pump discharges fluid from the first outlet at a first discharge pressure and the submersible pump is arranged to channel fluid to the second outlet arrangement at the first discharge pressure. However in an alternate embodiment the submersible pump may be arranged to channel fluid to the second outlet arrangement at second pressure which is less than the first discharge pressure.

In some of the above aspects the submersible pump may comprise a valve upstream of the second outlet arrangement, the valve being operable to control a volume of fluid being diverted to the second outlet arrangement.

In a fourth aspect there is disclosed a method of pumping a fluid from a body of the fluid the method comprising: at least partially submersing a pump in the body fluid to enable pumping of the fluid from the body to a first outlet and generating a flow of fluid in the body of fluid away from the pump.

In one embodiment generating the flow of fluid comprises returning a portion of the fluid being pumped by the pump back to the body of fluid.

In an alternate embodiment generating the flow of fluid comprises delivering a fluid from an alternate fluid source to the body of fluid.

BRIEF DESCRIPTION OF THE DRAWINGS

Notwithstanding any of the forms which may fall within the scope of the pump and method as set forth in the Summary, specific embodiments will now be described, by way of example only, with reference to the accompanying drawings in which.

DETAILED DESCRIPTION OF SPECIFIC EMBODIMENTS

Figure 1:
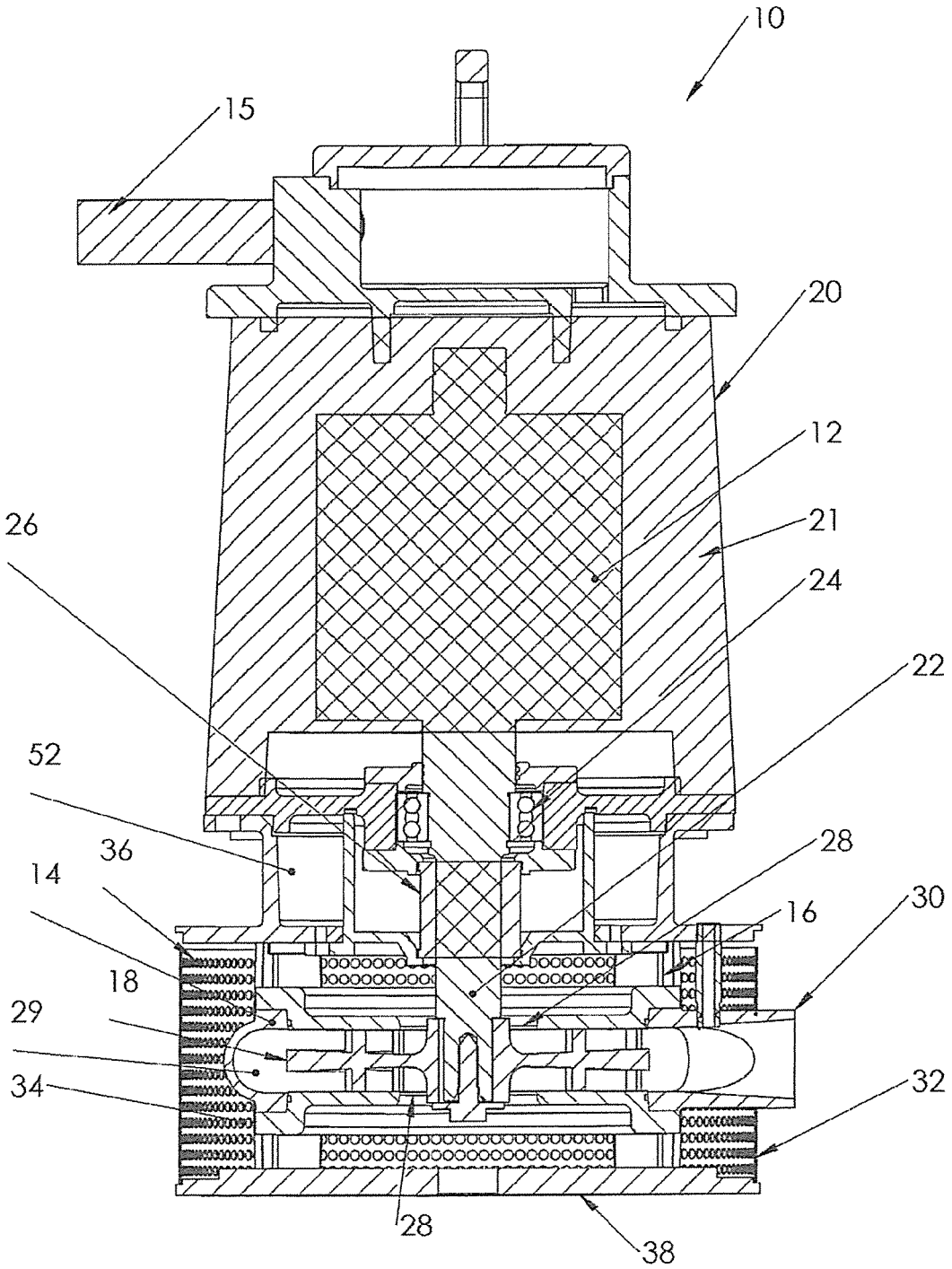
FIG. 1 is a schematic representation in section view of a prior art submersible pump.

FIG. 1 is a schematic representation of a prior art submersible pump 10. The submersible pump comprises an electric motor 12 arranged to drive a pump 14. An electrical power cable 15 is fixed to the submersible pump 10 to provide connection of the motor 12 to an electrical power source (not shown). The pump 14 comprises a case 16 and an impeller 18 disposed within the case 16. The submersible pump has an overall housing 20 which is made up of a first housing portion 21 that contains the motor and the pump case 16.

A drive shaft 22 of the electric motor 12 passes through a bearing 24 seated in the housing 20 and into the case 16 where it is attached to the impeller 18. Seal 26 operates to prevent fluid from passing into the housing 20. For ease of description only hereinafter the fluid will be exemplified as water.

The submersible pump 10 has an inlet 28 through which water can enter the pump 14 and in particular the pump case 16 when the impeller 18 is rotated by the motor 12. The pump case 16 defines a working fluid chamber 29 in which water is pressurized as it flows from the inlet 28 to a first outlet 30. Upon operation of the submersible pump 10 water entering the inlet 28 flows through the working fluid chamber 29 and is discharged under pressure through the outlet 30. A hose 50 may be attached to the outlet 30 to channel or direct the water to a location remote from that at which the pump 10 is operating.

An intermediate chamber 52 is formed between the case 16 and the first housing portion 21. The intermediate chamber 52 is in fluid communication with the working fluid chamber 29 and a water cooling jacket (not shown). The water cooling jacket surrounds the motor 12 and is within the first housing portion 21. Pressurized water circulates though the working fluid chamber 29, the intermediate chamber 52 and the water cooling jacket.

In this embodiment a strainer 32 forms a peripheral wall about the inlet 28. The strainer 32 is provided with a plurality of openings 34 through which water must flow to enter the inlet 28. The strainer 32 in effect forms an inlet chamber 36 for the pump 10.

The chamber 36 is closed by a plate 38 that extends across the bottom edge of the strainer 32.

Figure 2:
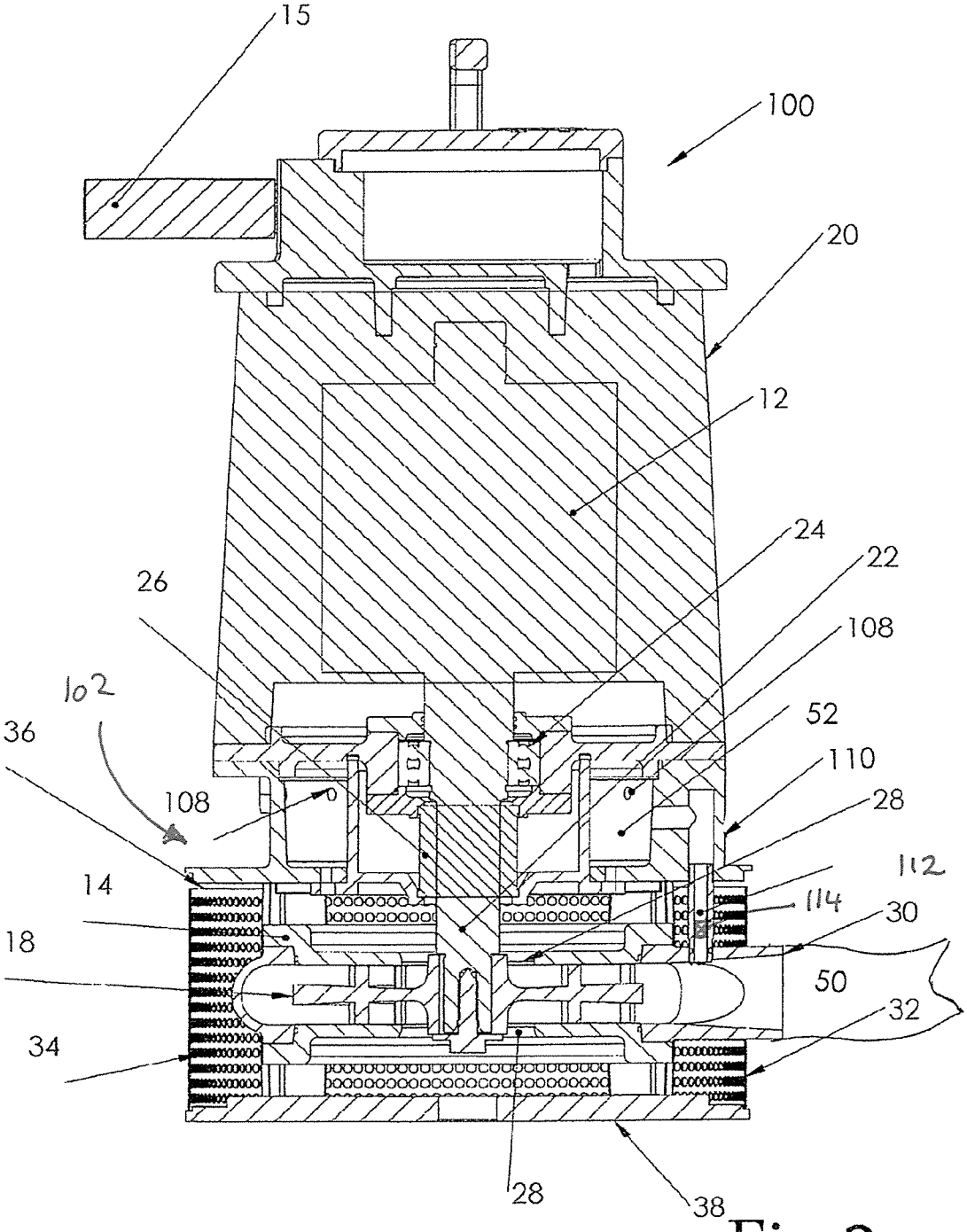
FIG. 2 is a schematic representation of a first embodiment of a submersible pump in accordance with the present disclosure.
Figure 3:
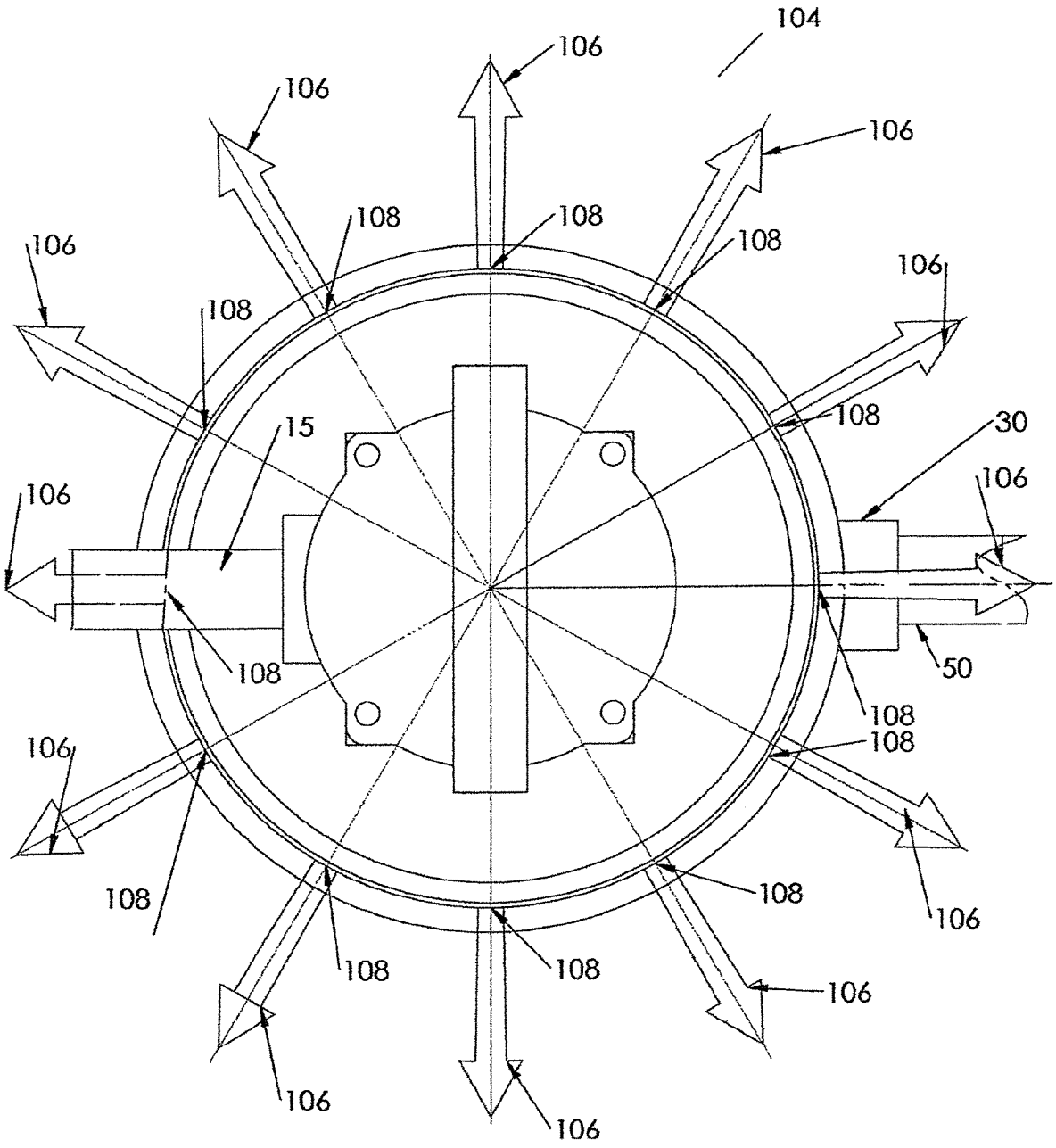
FIG. 3 is a plan view of the submersible pump shown in FIG. 2 in operation.

FIGS. 2 and 3 depict an embodiment of the disclosed submersible pump 100. In describing the submersible pump 100 the same reference numbers are used to denote the same features as in the prior art submersible pump 10 shown in FIG. 1. The submersible pump 100 differs from the prior art submersible pump 10 by the provision of a second outlet arrangement 102. A portion of the water from a pressure side of the pump 14 which is directed to the outlet 30 is diverted to the second outlet 102. The second outlet arrangement 102 is configured to produce a flow of water away from the pump 100.

FIG. 3 depicts the pump 100 in a body of water 104. The hose 50 is attached to the outlet 30 so that water from the body 104 can be pumped to a remote location. When the pump 100 is operated, a portion of the water entering the inlet 28 and directed to the outlet 30 is diverted to the second outlet system 102. This water flows out from the second outlet system 102 back into the body of water 104. The second outlet system 102 is arranged to create a flow of the water back into the body of water 104 and away from the pump 100.

In this embodiment the second outlet arrangement 102 is constituted by openings 108 formed in a wall 110 of the intermediate chamber 52, as well as a conduit 112 that supplies water from the pressure side of the pump 14 to the chamber 52. This portion of water is this diverted from flowing thought the outlet 30. Thus while water is being drawn into the pump 100 via the inlet 28 a portion of that water is returned to the body 104 creating a divergent flow of water away from the pump 100. The divergent flow is manifested as a number of water jets or sprays 106 emanating from respective second outlet openings 108 of the second outlet system 102.

Optionally a valve 114 is provided in the flow path between the pump 14 and the second outlet system 102 to control the volume and/or pressure of the divergent flow. For example in the event that the valve 114 is provided and is fully closed then no water is directed to the second outlet system 102. However the valve 114 may be progressively opened either continuously or by incremental amounts to a fully opened position to vary the portion of the volume of water being directed to the second outlet system 102.

As a consequence of the divergent flow, solid matter floating in the body of water 104 is pushed away from the pump 100. This reduces the risk of floating solid matter being entrained in the water entering the inlet 28. The divergent flow also minimises clogging of the strainer 32.

Figure 4:
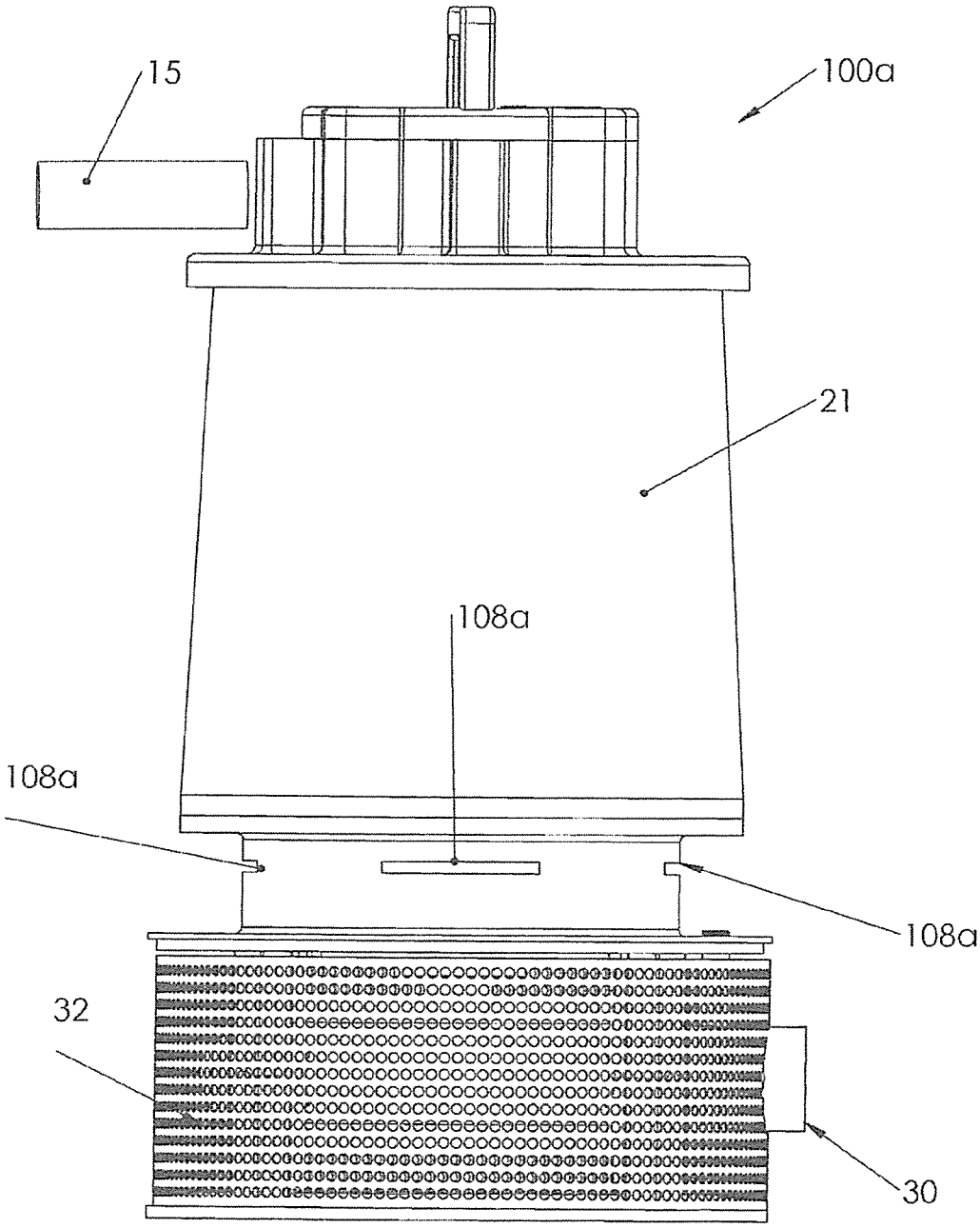
FIG. 4 is a schematic representation of a second embodiment of a submersible pump in accordance with the present disclosure.

FIG. 4 depicts an alternate embodiment of the pump 100*a*. The pump 100*a* differs from the pump 100 only in terms of the configuration of the outlet openings which in this embodiment are denoted by the reference 108*a*. In this embodiment the second openings 108*a* are in the form of slots rather than circular holes. The slots 108*a* produce respective laminar or sheet water flows away from the submersible pump 100. The submersible pump 100*a* may also have a valve (not shown) with identical functionality to the valve 114 to control the volume and/or pressure of water entering the second outlet 102*a*.

Whilst two embodiments have been described it should be appreciated that the submersible pump 100 and method of pumping may be embodied in many other forms. For example with particular reference to the embodiment of the pump 100*a*, instead of a plurality of spaced apart slots 108*a*, the second outlet 102 can be formed as a single continuous slot or opening wholly around the circumferential peripheral surface of the pump.

Figure 5:
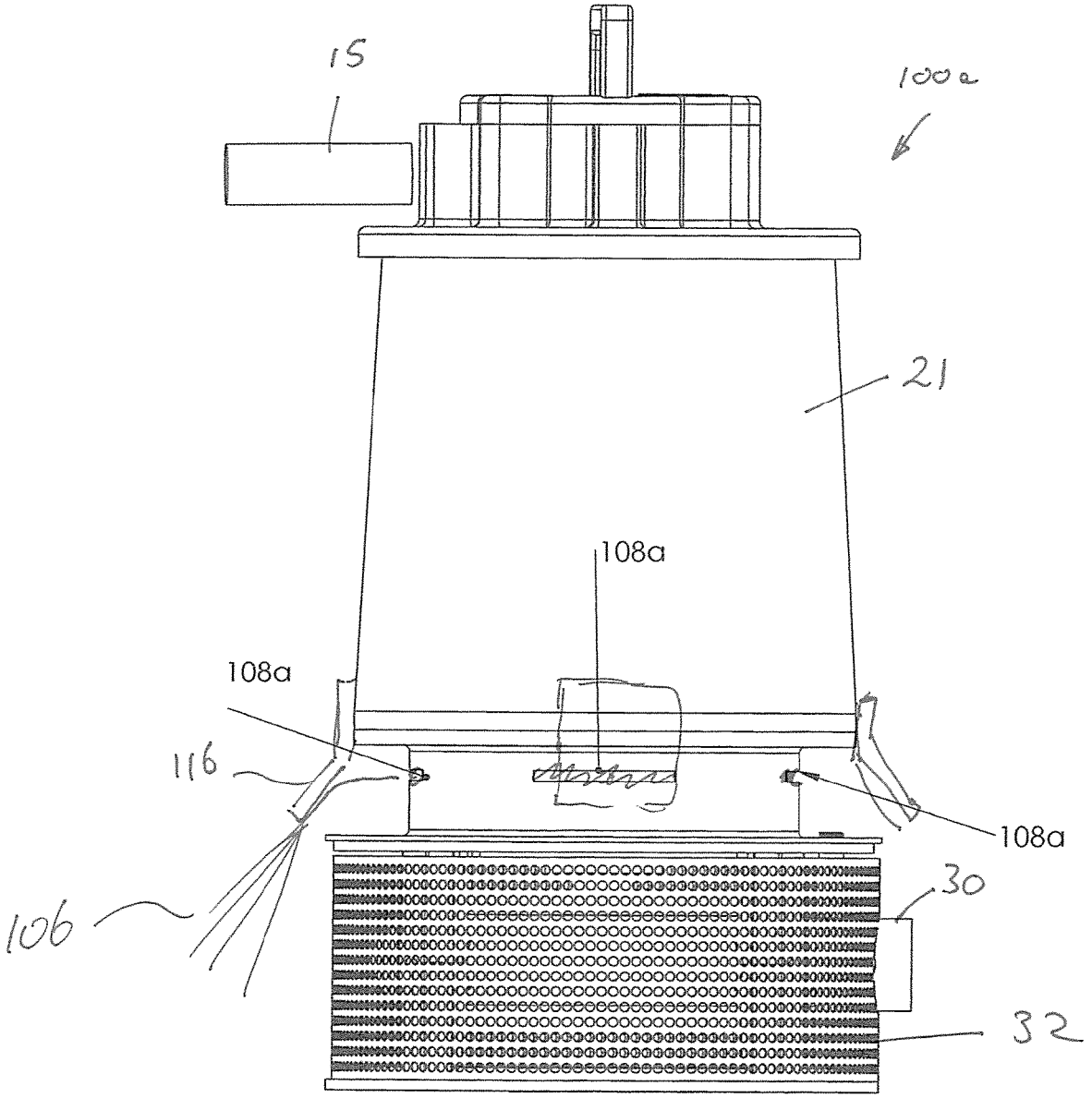
FIG. 5 is a schematic representation of a third embodiment of a submersible pump in accordance with the present disclosure.

Additionally as shown FIG. 5 deflectors 116 may be mounted to the housing 21 or other part of the pump 100 to produce a spray 118 of water from an opening 108/108*a*. The deflectors may be movable or otherwise adjustable to vary the spray patterns. For example to produce a vertical or horizontal spray.

A further alternate mechanism for producing the divergent flow may be in the form of a ring manifold located on the outside of and about a longitudinal axis of the submersible pump. The ring manifold is formed with openings similar to say the holes 108 or slots 108*a* and can be plumbed to a pressure side of the pump 14 or to the hose 50. Thus when the submersible pump 100 is operated a divergent flow is produced by water flowing out of the openings in the manifold.

Another way to produce is the divergent flow is to construct the submersible pump 100 with a: clearance or gap between the electric motor housing 12 and the pump case 16; and a bypass flow path from the working chamber 29 to the clearance or gap. Alternately such a clearance or gap can be introduced into the pump case 16 itself.

The effect and benefits of the divergent flow are independent of the: (a) method of apparatus to generate that flow; and (b) source of the fluid being used to generate that divergent flow. Thus for example the divergent flow can be generated by an auxiliary pump that is arranged to pump fluid from the body of the fluid to the second outlet arrangement. The auxiliary pump may be in the form of a small pump attached to or supported by the housing 20. In another example the fluid used to generate the divergent flow does not need to be sourced from the body of fluid being pumped. It may for example be sourced from a mains water supply. One simple way of achieving this is to attach a spray manifold about a housing 20 of the submersible pump 100 and plumb the manifold to a mains water supply.

In the above described embodiments the pump 14 is orientated or otherwise arrange as a bottom suction pump with the inlet 28 being disposed below or at a bottom end of the working fluid chamber 29. However this is not necessary. In an alternate embodiment the pump 14 may be arranged as a top suction pump. In such an embodiment the inlet 28 is located at an upper end of the working fluid chamber 29. In this way there is a gravity feed of water into the working chamber 29. Such an arrangement may simplify the sealing requirement about the drive shaft 22. Indeed the juxtaposition of the inlet 28 to the working chamber 29 is immaterial to the disclosed feature of providing a flow of water/fluid to the second outlet 102. In a further variation the pump may be arranged as a double suction pump.

Further while the use of an electric motor 12 is convenient for driving the pump 14, embodiments of the submersible pump may alternately incorporate different types of motor such as, but not limited to, a pneumatic motor or a hydraulic motor.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the bucket and corners as disclosed herein.

The invention claimed is:

1. A submersible pump for use in a body of fluid containing floating solid material comprising:

a fluid inlet, a first fluid outlet and a second fluid outlet arrangement, wherein at least the first fluid outlet is in fluid communication with the fluid inlet; and a strainer provided with a plurality of openings upstream of the fluid inlet; and forming an inlet chamber for the submersible pump;

the second fluid outlet arrangement having a) at least one outlet opening located in a peripheral surface of the submersible pump, or b) a manifold supported on and about a housing of the submersible pump formed with outlet openings, and the second fluid outlet arrangement being configured such that when the submersible pump is in a body of fluid containing solid floating material, a fluid can be delivered by the second outlet arrangement into the body of fluid from outside the inlet chamber in a manner to create a divergent flow of fluid in the body in a direction radially away from a circumferential surface of the submersible pump so as to direct unwanted floating solid matter away from the strainer.

2. The submersible pump according to claim 1, wherein the strainer forms a peripheral wall about the fluid inlet.

3. The submersible pump according to claim 2, wherein the circumferential surface of the submersible pump and the strainer are axially aligned.

4. The submersible pump according to claim 1 wherein the second fluid outlet arrangement is configured to receive fluid from the body of fluid and the fluid delivered by the second outlet arrangement is the fluid from the body of fluid.

5. The submersible pump according to claim 4 wherein the second outlet arrangement is in fluid communication with the fluid inlet.

6. The submersible pump according to claim 4 comprising an auxiliary pump supported on or in a housing of the submersible pump for pumping fluid from the body of fluid to the second outlet arrangement.

7. The submersible pump according to claim 1 wherein the second outlet arrangement is configured to receive fluid from: a fluid source other than the body of fluid; or a mains water source.

8. The submersible pump according to claim 1 wherein the inlet chamber is closed by a plate; and the strainer openings are configured to impede or prevent passage of solid material larger than a mesh size of the strainer from entering the fluid inlet.

9. The submersible pump according to claim 1, wherein the second fluid outlet arrangement has at least one outlet opening located in a peripheral surface of the submersible pump.

10. The submersible pump according to claim 1, wherein the second fluid outlet arrangement has a manifold supported on and about a housing of the submersible pump formed with outlet openings.

* * * * *